US006834400B2

(12) United States Patent
Zanardelli et al.

(10) Patent No.: US 6,834,400 B2
(45) Date of Patent: Dec. 28, 2004

(54) SECURING BATH SEATS

(75) Inventors: Kevin Zanardelli, Quincy, MA (US); James M. Buckley, New Hartford, CT (US); Bruce P. Popek, South Windsor, CT (US); Craig Bures, Prospect, CT (US); Thomas McDonald, Longmeadow, MA (US)

(73) Assignee: The First Years, Inc., Lake Forest, CA (US)

( * ) Notice: Subject to any disclaimer, the term of this patent is extended or adjusted under 35 U.S.C. 154(b) by 156 days.

(21) Appl. No.: 10/278,042

(22) Filed: Oct. 22, 2002

(65) Prior Publication Data

US 2004/0073995 A1 Apr. 22, 2004

(51) Int. Cl.[7] ..... A47K 3/024
(52) U.S. Cl. ..... 4/572.1
(58) Field of Search ..... 4/572.1, 579

(56) References Cited

U.S. PATENT DOCUMENTS 1,428,039 A * 9/1922 Kratz ..... 297/130
2,177,998 A * 10/1939 Schuette ..... 4/572.1
3,289,217 A * 12/1966 Glover ..... 4/562.1
4,837,871 A * 6/1989 Wheeler ..... 4/546
6,112,343 A 9/2000 Dixon
6,314,592 B1 11/2001 Stein

* cited by examiner

*Primary Examiner*—Charles E. Phillips
(74) *Attorney, Agent, or Firm*—Fish & Richardson P.C.

(57) ABSTRACT

A child bath seat, placed within and attached to a bathtub, includes a seat body that includes both a seat and a retaining structure extending above the seat for laterally retaining a child seated in the seat body. The seat also includes a bracing structure that holds the seat body in an upright position. The bracing structure has a first end attached to the seat body, and a second end, defining a recess, for receiving an upper edge of a side of the bathtub. The bracing structure can be a clamp. The child bath seat can be adjustable to accommodate varying bathtub side widths and varying bathtub depths. The child bath seat can be suspended above or a portion of the bath seat can rest on the bottom surface of the bathtub.

23 Claims, 8 Drawing Sheets

SECURING BATH SEATS

BACKGROUND

The invention relates to child bath seats, such as are used for bathing children.

Children are often placed in a bath seat for support during bathing in a bathtub. Often the bathtub is filled with about an inch of water and the adult uses a sponge or a face cloth to bathe the child while the child sits secured in the child bath seat. Concerns have been raised about the safety of child bath seats, particularly when parents improperly leave the child alone in the bathtub. Improvements are sought in the safety and convenience of bath seats in general.

SUMMARY

In one aspect, the invention features a child bath seat, placed within and attached to a bathtub. The child bath seat includes a seat body that includes both a seat and a retaining structure extending above the seat for laterally retaining a child seated in the seat body. The seat also includes a bracing structure that holds the seat body in an upright position. The bracing structure has a first end attached to the seat body, and a second end, defining a recess, for receiving an upper edge of a side of the bathtub.

Various embodiments have one or more of the following features. For example, the child bath seat may include a clamping mechanism that secures the second end of the bracing structure to the side of the bathtub. Also, the bracing structure may include a horizontal adjustment bracket that allows adjustment of the bracing structure, which corresponds to a width of the side of the bathtub. In addition, the bracing structure may include a vertical adjustment bracket to adjust a vertical position of the seat relative to a bottom surface of the bathtub.

Other embodiments feature a bath seat including a support member attached to a bottom surface of the seat. The bath seat may engage the bottom surface of the bathtub only on a side of the bath seat opposite the bracing structure.

In still other features, the child bath seat, in its upright position and resting on a bottom surface of the bathtub, contacts the bottom surface of the bathtub only on one side of a center gravity of the seat body. Further, the seat body may rest on the bottom surface of the bathtub. Alternatively, the seat body may be suspended over the bottom surface of the bathtub.

In another aspect the invention features a child bath seat placed within and clamped to a bathtub. The child bath seat includes a seat body that includes both a seat and a retaining structure above the seat for laterally retaining a child in the seat body. The child bath seat also includes a bracing structure that holds the seat in an upright position. The bracing structure has a first end attached to the seat body, and a second end that has a clamp secured over an upper edge of the bathtub.

Various embodiments of this aspect have one or more of the features described above.

In another aspect, the invention features a method of securing a bath seat within a bathtub for bathing a child therein. The method includes placing the bath seat into the bathtub. The bath seat includes a seat that includes both a seat and retaining structure extending above the seat for laterally retaining a child in the seat body, and a bracing structure that has a first end attached to the seat body, and a second end defining a recess. The method also includes attaching the second end of the bracing structure over an upper edge of a side of the tub, with the upper edge of the side of the tub received in said recess and the seat body in an upright position.

Various embodiments have one or more of the following features. For example, a horizontal adjustment bracket may be adjusted on the bracing structure to correspond to a width of the side of the bathtub. In addition, a vertical position of the seat may be adjusted relative to a bottom surface of the bathtub.

In other features, the bottom surface of the bathtub may be engaged only on a side of the bath seat opposite the bracing structure. Further, the bottom surface of the bathtub may be contacted only on one side of a center of gravity of the seat body in its upright position. Alternatively, the seat body may be suspended over the bottom surface of the bathtub.

In another aspect, the invention features a method for bathing a child. The method includes placing a child bath seat in a tub. The child bath seat includes a seat body that includes both a seat and retaining structure above the seat for laterally retaining a child in the seat body, and a bracing structure that has a first end attached to the seat body, and a second end defining a recess for receiving an upper edge of a side of the tub with the seat body placed within the tub to hold the seat body in an upright position. The method also includes attaching the second end of the bracing structure over the upper edge of the side of the tub, inserting the child into the seat body, and securing the child within the retaining structure.

Various embodiments of this aspect have one or more of the following features described above.

Various aspects of the invention can provide advantages in the function and convenience of child bath seats. For example, the bracing structure holds the bath seat firmly in place thereby preventing the child seat from tipping over during bathing or when the child is physically active. The bracing structure can also be adjusted to conform to non-standard bathtub side widths. Thus, one bath seat can be used in multiple locations and brought along during travel.

In other advantages, the bath seat can be adjustable to change the relative height of the bath seat to adapt to multiple tubs of varying depths. Thus, the bath seat can be used longer as the child grows in height or for children of different sizes. Further, the bath seat can also be structured to advantageously deter parents from placing children in the seat unless the bath seat is first properly secured in the bathtub.

Other features, objects, and advantages of the invention will be apparent from the description and drawings, and from the claims.

DESCRIPTION OF THE DRAWINGS

Like reference symbols in the various drawings indicate like elements.

DESCRIPTION

Figure 1A:
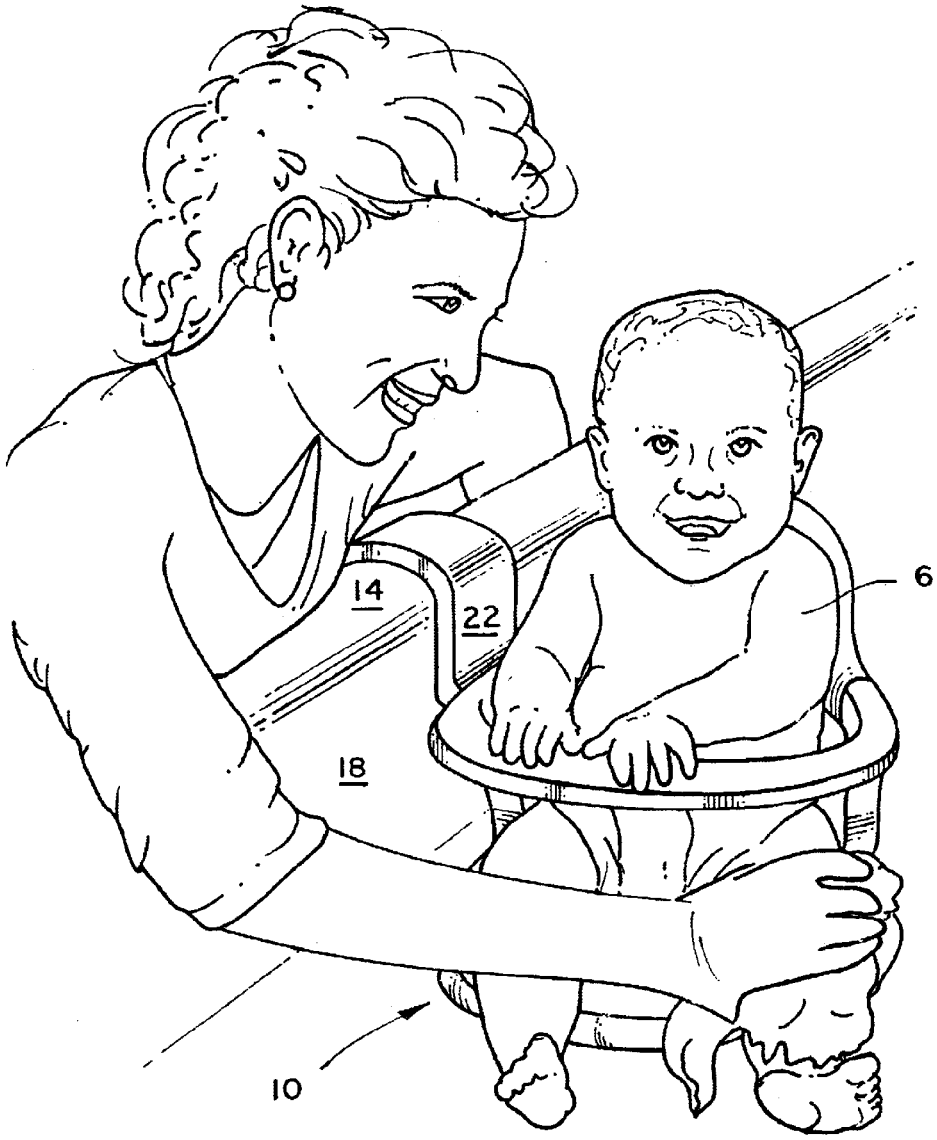
FIG. 1A is a view of a bracing child bath seat with a child.

FIG. 1A illustrates a child 6 sitting in a bracing child bath seat 10 that is secured to a rim 14 of a bathtub 18. Bath seat 10 includes a bracing structure 22 and a seat body 26 that holds child 6. As will be explained below, when attached to rim 14, bracing structure 12 secures seat body 14 firmly in place, thereby preventing child 6 from tipping bath seat 10 over during bathing or during the child's movements.

Figure 1B:
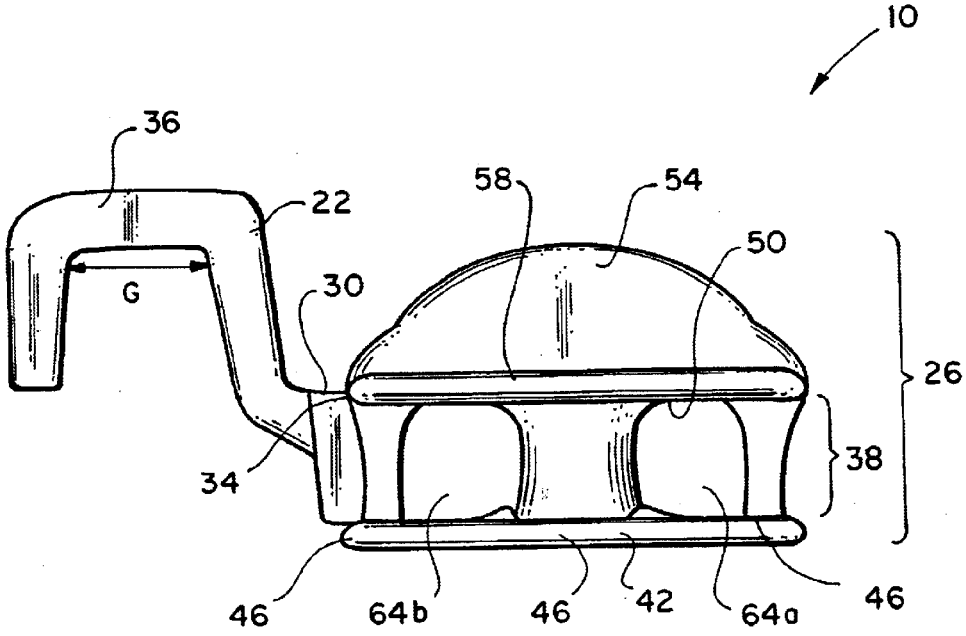
FIG. 1B is a front view of the bracing child bath seat.

Referring to FIG. 1B, bracing structure 22 is molded at a proximal end 30 to a side 34 of seat body 26. A distal end 36 of bracing structure 22 is shaped to correspond to the shape of rim 14. Distal end 36 forms a gap, G, that accommodates the width of rim 14 so that when distal end 36 of bracing structure 22 is placed over the rim, the distal end wraps around the rim providing a snug fit between the bracing structure and the rim.

Seat body 26 includes a retaining barrier 38 and a seat 42, which is attached to the bottom surfaces 46 of retaining barrier 38, e.g., snapped or screwed together. Retaining barrier 38 includes a front restraint 50 and a back restraint 54 is attached using molded snaps (not shown) to front restraint 50. Front restraint 50 includes a smooth top surface 58 so that child 6 can rest their arms during bathing. Together seat 42, front restraint 50 and back restraint 54 form a cavity 62 in which child 6 is placed for bathing. In addition, front restraint 50 and seat 42 form two apertures 64*a* and 64*b*, each wide enough so that a leg of child 6 may pass through the aperture. Each component of bath seat 10 is fabricated from injection-molded plastic.

During typically bathing activity, an adult places distal end 36 of bracing structure 22 over rim 14 of bathtub 18. The adult guides the child through cavity 62 while simultaneously putting the child's legs through apertures 64*a* and 64*b*.

In this embodiment, a portion of the seat rests on the bottom surface of the bathtub. In other embodiments, however, the installed seat is suspended over the bottom of the bathtub.

Figure 2A:
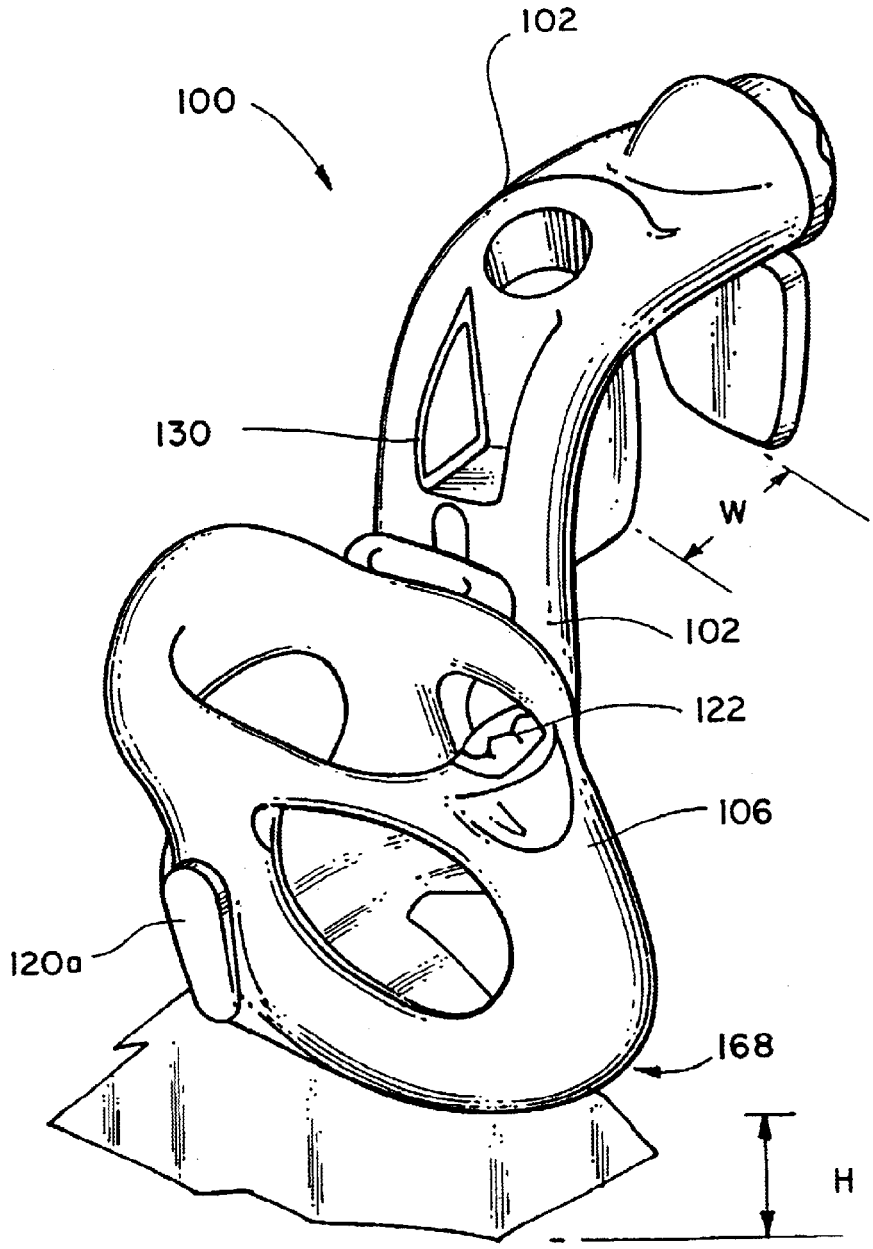
FIG. 2A shows a second example of a bracing child bath seat, with an adjustable bracing structure.
Figure 2B:
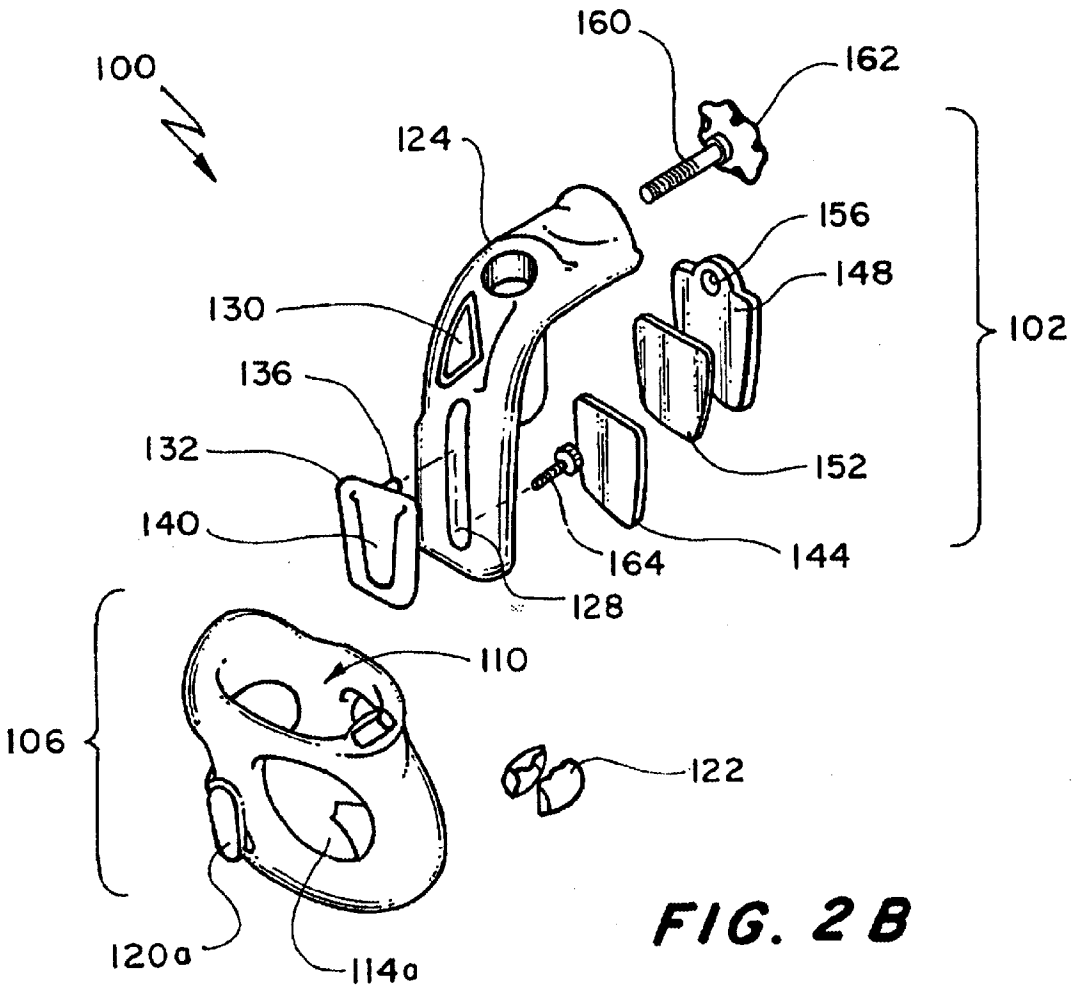
FIG. 2B is an exploded view of the embodiment in FIG. 2A.
Figure 3A:
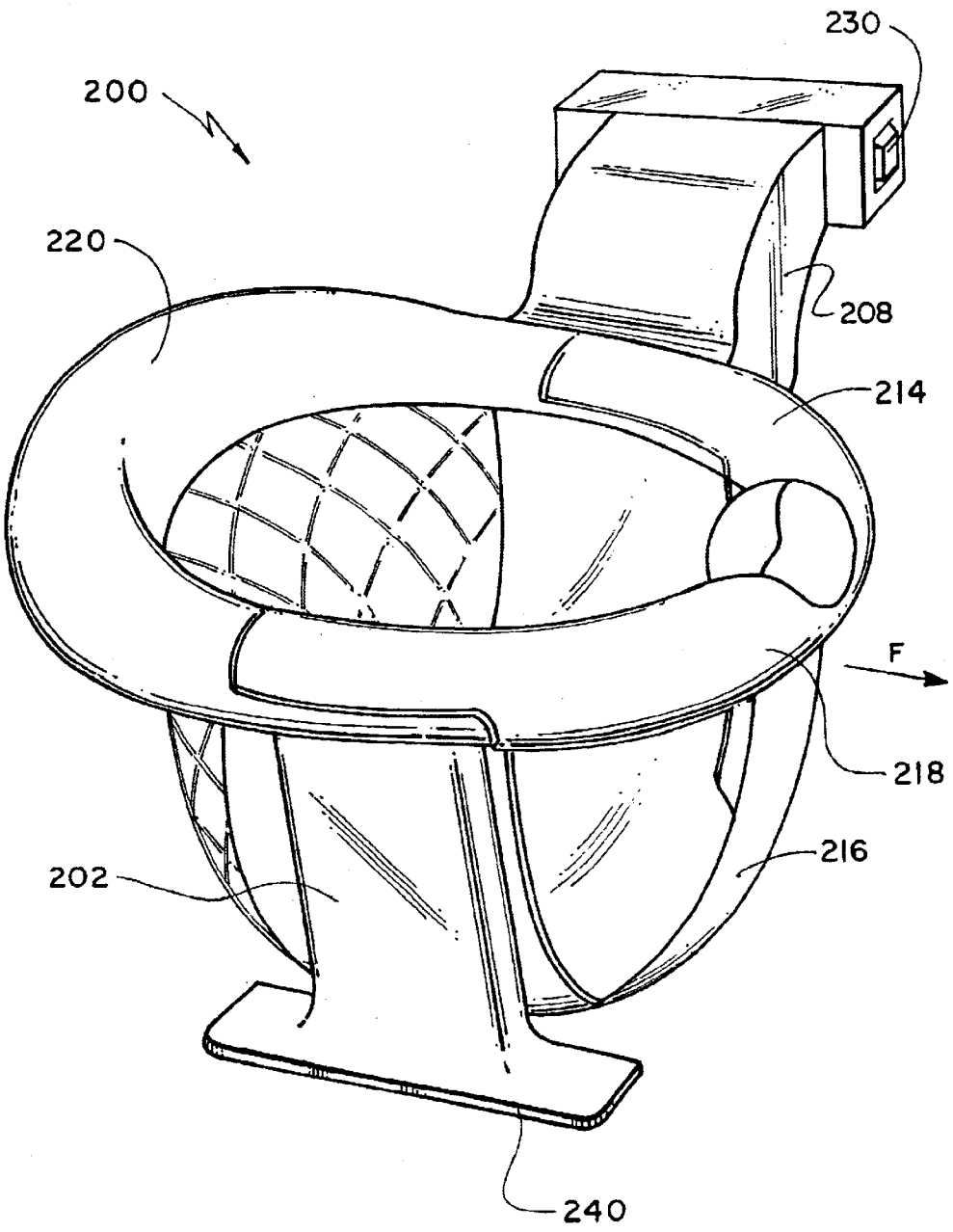
FIG. 3A shows a third example of a bracing child bath seat.
Figure 3B:
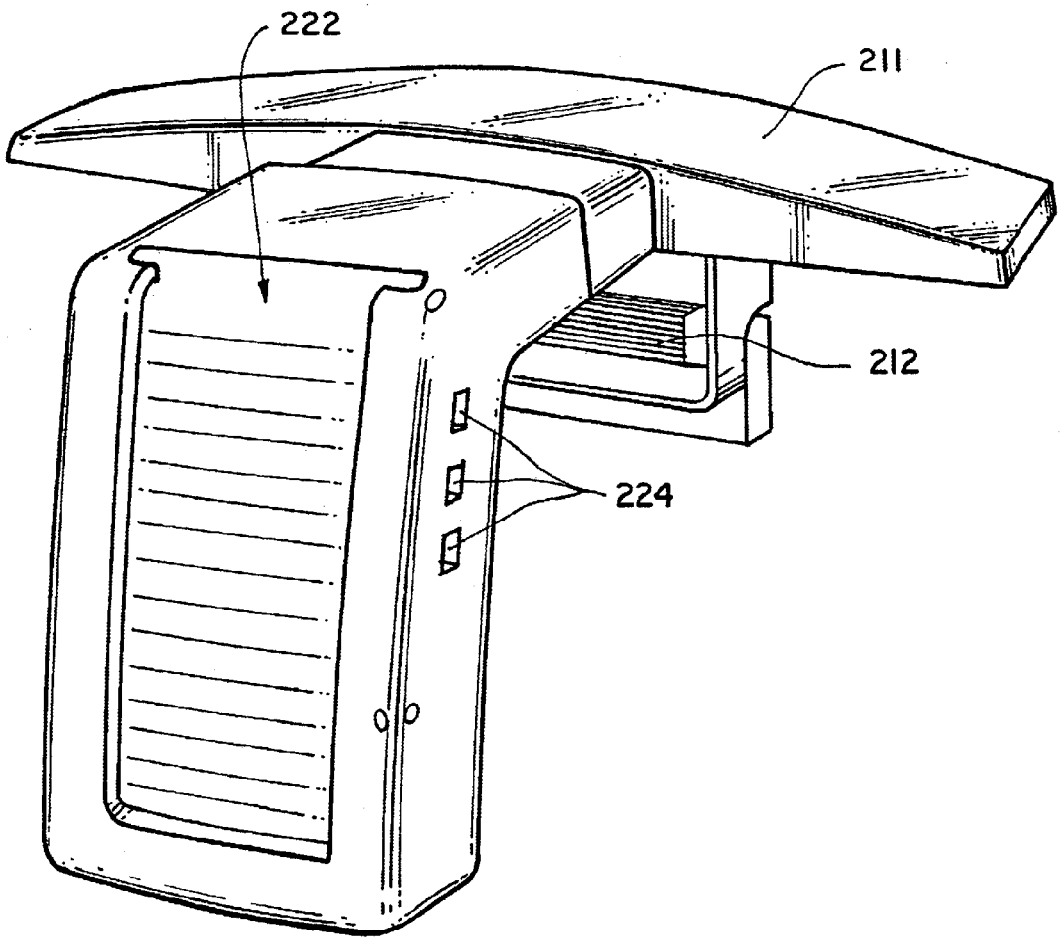
FIG. 3B is a perspective view of the clamp shown in FIG. 3A.
Figure 3C:
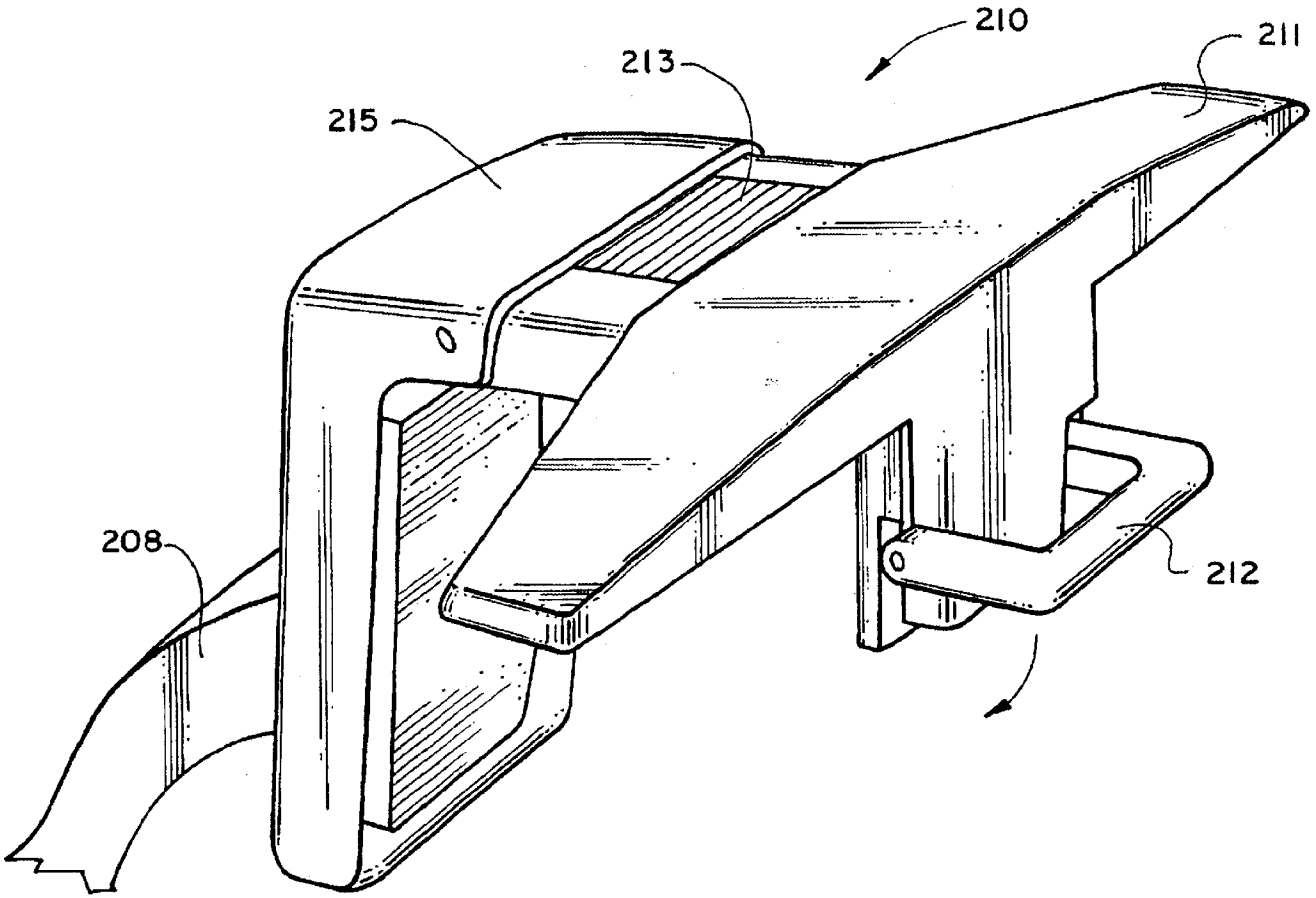
FIG. 3C is a perspective view of the clamp and shuttle shown in FIG. 3A.
Figure 3D:
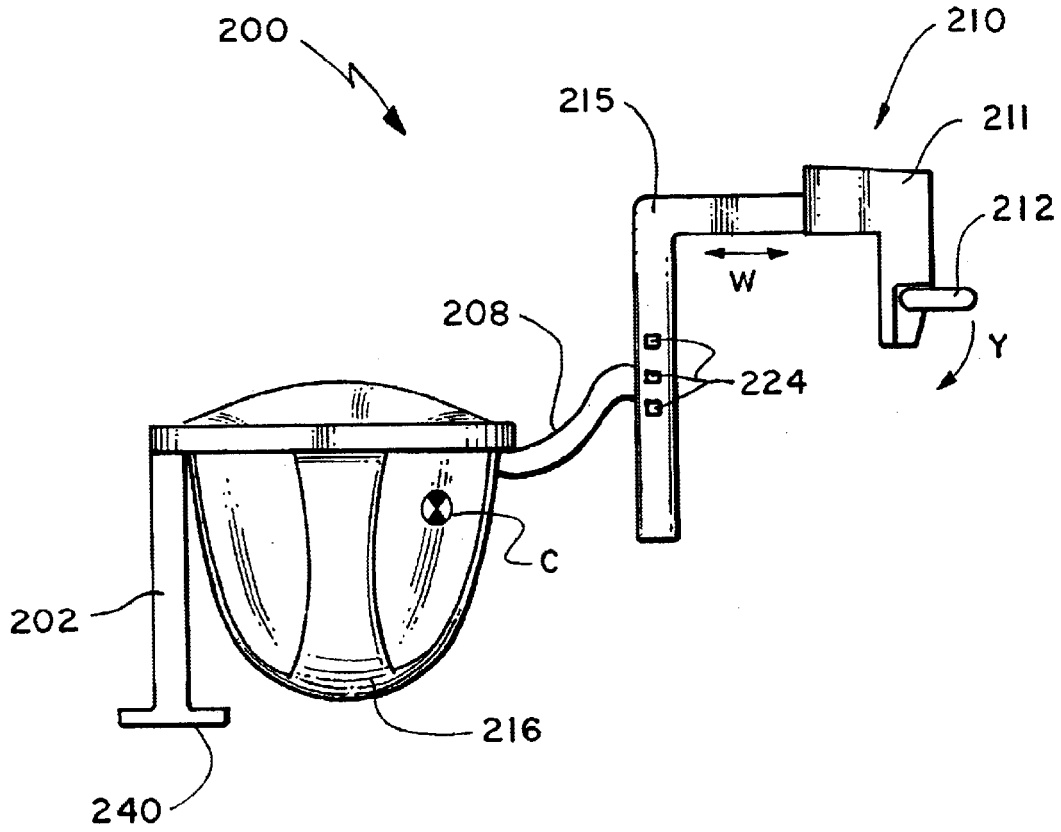
FIG. 3D is a front view of the embodiment of FIG. 3A.

Referring to FIGS. 2A and 2B, a second example of a bracing bath seat 100 includes an adjustable bracing structure 102 for bracing with non-standard width bathtub rims and for adjusting a height, H, of the bath seat relative to the bottom of the bathtub. Child bath seat 100 includes adjustable bracing structure 102 and a seat body 106. Seat body 106 includes a cavity 110 to receive child 6 and two openings 114*a* and 114*b*, each for receiving a leg of child 6. Seat body 106 also includes two flanges 120*a* and 120*b* located on opposite sides of seat body 106. Seat body 106 includes a toy rattle 122 for entertaining and distracting the child during bathing.

Adjustable bracing structure 102 includes a clamp housing 124 defining a channel 128 and a recess 130; a shuttle 132 having a dowel 136 and a slot 140; an inner pad 144; and a clamp plate 148 having an outer pad 152 and an aperture 156. Adjustable bracing structure 102 also includes adjustment screw threads (not shown) for receiving an adjustment screw 160 having a handle 162. Bath seat 110 is installed by placing dowel 136 of shuttle 132 into channel 128. As will be discussed below, the location where dowel 136 is placed along channel 128 determines a height, H, of bath seat 100 relative to a bottom 168 of the bathtub. Dowel 132 includes locking screw threads (not shown) for receiving a locking screw 164. Locking screw 164 is inserted through channel 128 and is received by the locking screw threads. Locking screw 164 is subsequently tightened to lock shuttle 132 to clamp housing 124.

Adjustable bracing structure 102 is secured to bathtub 18 by placing the inner pad 144 on the inside of the bathtub rim and clamp plate 148 on the outside of the bathtub rim with outer pad 152 in contact with the outer rim. Adjustment screw 160 is inserted through aperture 156 and is received by the adjustment screw threads. As adjustment screw 160 is tightened, clamp plate 148 moves closer to inner pad 144, thus the distance, W, between inner pad 144 and outer pad 152 is reduced until W equals the width of the bathtub, preferably until a sufficient clamp force develops between the bracing structure and the bathtub rim to secure the bath seat against movement during bathing.

Once adjustable bracing structure 102 is secured to bathtub 18, seat body 106 is connected to the adjustable bracing structure by lifting the seat body and sliding one of the flanges 120*a* and 120*b* into slot 140. The height, H, between a bottom 168 of bath seat 100 and the bottom of the bathtub, can be adjusted by moving shuttle 132 up or down along channel 128. By having flanges 120*a* and 120*b*, on each side, bath seat 100 can be mounted on each side.

Since bracing structure 102 is clamped tightly on the bathtub rim, bath seat 100 will be held securely in.

Clamp housing 124 and seat 106 components are fabricated using blow-molding techniques. Shuttle 132, clamp plate 148, and handle 162 components are fabricated using injection molding.

Recess 130 is used to store soap, sponges or shampoo. In other embodiments, other recesses may be added to bath seat 100 and used to store other bathing items.

In a third example of a bracing bath seat 200, as shown in FIGS. 3A–3D, the bath seat is partially stabilized by a leg 202 that contacts the bottom surface of the bathtub. Bath seat 200 includes an adjustable bracing structure 204, attached to an adjustable rail 214, and a seat sling 216, attached to the bottom of the adjustable rail.

Adjustable bracing structure 240 includes a shuttle 208 that is detachably connected to a clamp assembly 210. Clamp assembly 210 includes a front piece 211 having an adjustable track 213 and a back piece 215. Shuttle 208 is engaged to clamp 210 by sliding the shuttle along a channel 222 on back piece 215. A spring-loaded button 230 on shuttle 208 is depressed prior to inserting shuttle 208 into channel 222 and remains depressed as the shuttle moves along the channel until the button aligns with one of a set of buttonholes 224. Button 230 is released thereby locking shuttle 208 to clamp 210. Shuttle 208 is disengaged from clamp 210 by pressing button 230 and moving the shuttle out of channel 222. Thus, an adult can easily use the bathtub by pushing button 230 and removing the entire bath seat except for clamp 210.

Adjustable rail 214 includes a front portion 218 and a back portion 220 attached together using a molded in track. Front portion 218 can be moved in a direction, F, away from back portion 220 along the molded track to adjust to the child's size.

Support leg 202 extends from back portion 220 opposite shuttle 208. With bath seat 200 in an upright intended use position and resting on a horizontal surface, the bath seat contacts the horizontal surface only on one side of its center of gravity, C. Bath seat 200 is constructed to not remain in an upright, intended use position when resting on a horizontal support surface without placing shuttle 208 into clamp assembly 210. This is intended to help deter the adult from placing the child in bath seat 200 unless and until the bath seat is secured to the rim of the bathtub. Support leg 211 includes a rubber bottom surface 240 to prevent slipping on a wet surface.

Attachment and adjustment of clamp assembly 210 to the side of the bathtubs of varying widths is accomplished by sliding back piece 215 along adjustment track 213 of front piece 211. Adjustment track 213 allows incremental adjustment of clamp assembly 210 to the bathtub side. A center cam lock 212 is used for the final tightening of bath seat 200 to a tub outside wall by moving cam lock 212 in a Y direction.

Each of the embodiments described herein may have one or more of the features described in the other embodiments. Other embodiments not described herein are also within the scope of the following claims.

What is claimed is:

1. A child bath seat placed within and attached to a bathtub, the bath seat comprising:

a seat body including both a seat and a retaining structure extending above the seat for laterally retaining a child seated in the seat body; and a bracing structure holding the seat body in an upright position, the bracing structure having a first end attached to the seat body, and a second end defining a recess receiving an upper edge of a side of the bathtub;

wherein the bracing structure includes a vertical adjustment bracket to adjust a vertical position of the seat relative to a bottom surface of the bathtub.

2. The child bath seat of claim 1, further comprising:

a clamping mechanism securing the second end of the bracing structure to the side of the bathtub.

3. The child bath seat of claim 2, wherein the bracing structure includes a horizontal adjustment bracket that allows adjustment of the bracing structure corresponding to a width of the side of the bathtub.

4. The child bath seat of claim 1, further comprising:

a support member attached to a bottom surface of the seat.

5. The child bath seat of claim 4, wherein the bath seat engages a bottom surface of the bathtub only on a side of the bath seat opposite the bracing structure.

6. The child bath seat of claim 5, wherein the child bath seat, in its upright position and resting on a bottom surface of the bathtub, contacts the bottom surface of the bathtub only on one side of a center gravity of the seat body.

7. The child bath seat of claim 1, wherein the seat body is suspended over the bottom surface of the bathtub.

8. The child bath seat of claim 1, wherein the seat body rests on the bottom surface of the bathtub.

9. A child bath seat placed within and clamped to a bathtub, the child bath seat comprising:

a seat body including both a seat and a retaining structure above the seat for laterally retaining a child in the seat body; and a bracing structure holding the seat in an upright position, the bracing structure having a first end attached to the seat body, and a second end having a clamp secured over an upper edge of the bathtub;

wherein the bracing structure includes a vertical adjustment bracket to adjust a vertical position of the seat relative to a bottom surface of the bathtub.

10. The child seat of claim 9, wherein the bracing structure includes a horizontal adjustment bracket that allows adjustment of the bracing structure corresponding to a width of the side of the bathtub.

11. The child seat of claim 9, wherein the bath seat engages a bottom surface of the bathtub only on a side of the bath seat opposite the bracing structure.

12. The child bath seat of claim 11, wherein the child bath seat, in its upright position and resting on the bottom surface of the bathtub, contacts the bottom surface of the bathtub only on one side of a center of gravity of the bath seat.

13. The child bath seat of claim 9, wherein the seat body is suspended over the bottom surface of the bathtub.

14. A method of securing a bath seat within a bathtub for bathing a child therein, comprising:

placing the bath seat into the bathtub, the bath seat including;

a seat body including both a seat and retaining structure extending above the seat for laterally retaining a child in the seat body; and a bracing structure having a first end attached to the seat body, a second end defining a recess, and a vertical adjustment bracket;

attaching the second end of the bracing structure over an upper edge of a side of the tub, with the upper edge of the side of the tub received in said recess and the seat body in an upright position; and adjusting the vertical adjustment bracket to change a vertical position of the seat relative to a bottom surface of the bathtub.

15. The method of claim 14, further comprising:

adjusting a horizontal adjustment bracket on the bracing structure to correspond to a width of the side of the bathtub.

16. The method of claim 14, further comprising:

engaging a bottom surface of the bathtub with the bath seat only on a side of the bath seat opposite the bracing structure.

17. The method of claim 16, wherein the bath seat is positioned to contact the bottom surface of the bathtub only on one side of a center of gravity of the seat body in its upright position.

18. The method of claim 14, wherein the bath seat is suspended over the bottom surface of the bathtub.

19. A method for bathing a child, comprising placing a child bath seat in a tub, the child bath seat including:

a seat body including both a seat and retaining structure above the seat for laterally retaining a child in the seat body; and a bracing structure having a first end attached to the seat body, a second end defining a recess for receiving an upper edge of a side of the tub with the seat body placed within the tub to hold the seat body in an upright position, and a vertical adjustment bracket;

attaching the second end of the bracing structure over the upper edge of the side of the tub;

inserting the child into the seat body;

securing the child within the retaining structure; and adjusting the vertical adjustment bracket to change a vertical position of the seat relative to a bottom surface of the bathtub.

20. The method of claim 19, further comprising:

adjusting a horizontal adjustment bracket on the bracing structure to correspond to a width of the side of the bathtub.

21. The method of claim 19, further comprising:

engaging a bottom surface of the bathtub with bath seat only on a side of the bath seat opposite the bracing structure.

22. The method of claim 21, wherein the bath seat is positioned to contact the bottom surface of the bathtub only on one side of a center of gravity of the seat body in its upright position.

23. The method of claim 19, wherein the bath seat is suspended over the bottom surface of the bathtub.

* * * * *

US006834400C1

(12) EX PARTE REEXAMINATION CERTIFICATE (6301st)

United States Patent

Zanardelli et al.

(10) Number: US 6,834,400 C1

(45) Certificate Issued: Jul. 15, 2008

(54) SECURING BATH SEATS

(75) Inventors: Kevin Zanardelli, Quincy, MA (US); James M. Buckley, New Hartford, CT (US); Bruce P. Popek, South Windsor, CT (US); Craig Bures, Prospect, CT (US); Thomas McDonald, Longmeadow, MA (US)

(73) Assignee: The First Years Inc., Lake Forest, CA (US)

Reexamination Request:
No. 90/008,041, Jul. 7, 2006

Reexamination Certificate for:

| | |
|---|---|
| Patent No.: | **6,834,400** |
| Issued: | **Dec. 28, 2004** |
| Appl. No.: | **10/278,042** |
| Filed: | **Oct. 22, 2002** |

(51) Int. Cl.
*A47K 3/024* (2006.01)

(52) U.S. Cl. ..... 4/572.1

(58) Field of Classification Search ..... None
See application file for complete search history.

(56) References Cited

U.S. PATENT DOCUMENTS

| | | | |
|---|---|---|---|
| 337,001 | A | 3/1886 | Kelley |
| 362,969 | A | 5/1887 | Jacobus |
| 488,011 | A | 12/1892 | Keene |
| 602,125 | A | 4/1898 | Burrows |
| 642,168 | A | 1/1900 | Smith |
| 1,245,660 | A | 11/1917 | Behm |
| 1,428,039 | A | 9/1922 | Kratz |
| 2,177,998 | A | 10/1939 | Schuette |
| 3,022,518 | A | 2/1962 | Hayden |
| 3,289,217 | A | 12/1966 | Glover |
| 4,472,844 | A | 9/1984 | Mace |
| 4,837,871 | A | 6/1989 | Wheeler |
| 5,097,542 | A | 3/1992 | Roesler |
| 5,158,460 | A | 10/1992 | Bernstein et al. |
| 6,112,343 | A | 9/2000 | Dixon |
| 6,314,592 | B1 | 11/2001 | Stein |
| 7,058,995 | B2 | 6/2006 | Sundberg et al. |

FOREIGN PATENT DOCUMENTS

| | | |
|---|---|---|
| GB | 2 320 187 | 6/1998 |
| GB | 2406271 | 3/2005 |
| JP | 2198529 | 8/1990 |
| JP | 8024152 | 1/1996 |
| JP | HEI 11-123152 | 5/1999 |
| JP | 2004081788 | 3/2004 |
| WO | WO 03/003891 | 1/2003 |

*Primary Examiner*—Jeffrey R Jastrzab

(57) ABSTRACT

A child bath seat, placed within and attached to a bathtub, includes a seat body that includes both a seat and a retaining structure extending above the seat for laterally retaining a child seated in the seat body. The seat also includes a bracing structure that holds the seat body in an upright position. The bracing structure has a first end attached to the seat body, and a second end, defining a recess, for receiving an upper edge of a side of the bathtub. The bracing structure can be a clamp. The child bath seat can be adjustable to accommodate varying bathtub side widths and varying bathtub depths. The child bath seat can be suspended above or a portion of the bath seat can rest on the bottom surface of the bathtub.

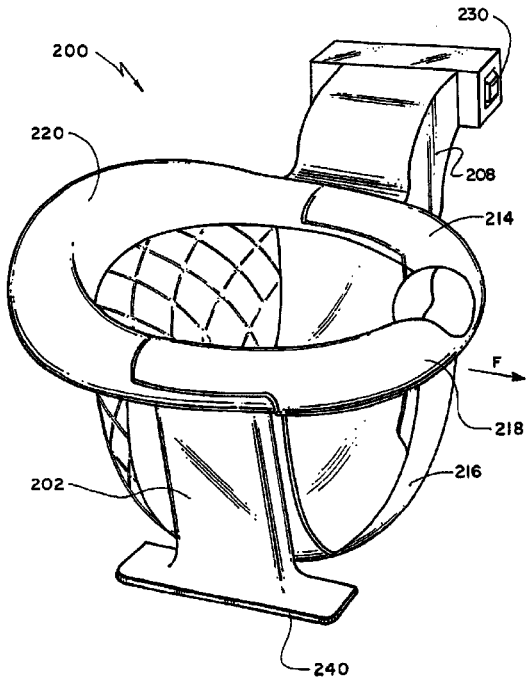

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–4, 7–10, 13–15, 18–20 and 23 are cancelled.

Claims 5, 6, 11, 12, 16, 17, 21 and 22 were not reexamined.

* * * * *